United States Patent [19]

Belloni

[11] Patent Number: 4,937,430

[45] Date of Patent: Jun. 26, 1990

[54] UTILITY STEAM GENERATOR WITH SELF-CONTROLLED PRESSURE MORE PARTICULARLY FOR LITTLE HOUSEHOLD ELECTRIC APPLIANCES

[75] Inventor: Cesare Belloni, Nerviano, Italy

[73] Assignee: Termozeta Elettrodomestici S.p.A., Parabiago, Italy

[21] Appl. No.: 375,012

[22] PCT Filed: Oct. 9, 1987

[86] PCT No.: PCT/EP87/00604

§ 371 Date: Jun. 2, 1989

§ 102(e) Date: Jun. 2, 1989

[87] PCT Pub. No.: WO89/03496

PCT Pub. Date: Apr. 20, 1989

[51] Int. Cl.[5] ..... F22B 1/28

[52] U.S. Cl. ..... 219/272; 219/512

[58] Field of Search ..... 219/271–276, 219/512; 236/30; 200/81.8; 337/306, 307, 322

[56] References Cited

U.S. PATENT DOCUMENTS

| | | | |
|---|---|---|---|
| 961,402 | 6/1910 | Brukenhaus | 236/30 |
| 1,212,567 | 1/1917 | Schneider | 200/81.8 |
| 1,821,853 | 9/1931 | Short | 200/81.8 |
| 2,387,175 | 10/1945 | Osterheld | 219/512 |

FOREIGN PATENT DOCUMENTS

| | | | |
|---|---|---|---|
| 672753 | 3/1939 | Fed. Rep. of Germany | 219/512 |

*Primary Examiner*—Teresa J. Walberg

*Attorney, Agent, or Firm*—Parmelee, Bollinger & Bramblett

[57] ABSTRACT

In a utility steam generator for small household electric appliances, steam pressure and filling water supply to the boiler is automatically controlled merely by a microswitch and a temperature controller, rather than by conventional devices such as pressure switches and maximum and minimum level controlling devices. The boiler body has a U-shaped pipe closed at both ends to form two legs, which are arranged on two superposed planes, so that the lower leg is the true boiler containing water and a heater and the upper leg is a steam dome. Control of steam pressure is effected by utilizing the variation of curvature of the pipe when the internal pressure varies, with a microswitch being used to switch the electric heating resistance on and off. The microswitch is mounted between the ends of the two legs of the U-shaped pipe, so the microswitch is closed by the two ends approaching one another when the pressure inside the pipe is reduced and the current is fed to the electric heater. The microswitch is opened, disconnecting the current supply, when the legs are spread apart a distance corresponding to the maximum pressure desired in the generator. The water feed pump is controlled by use of a thermostat, which can be arranged so the pump is actuated when the water level decreases and the pump is stopped when the mass on which the temperature controller is arranged cools down under the effect of the supply of cold water to the boiler.

9 Claims, 4 Drawing Sheets

UTILITY STEAM GENERATOR WITH SELF-CONTROLLED PRESSURE MORE PARTICULARLY FOR LITTLE HOUSEHOLD ELECTRIC APPLIANCES

BACKGROUND OF THE INVENTION

The present invention relates to a utility steam generator with self-controlled pressure which is especially adapted to be used with little household electric appliances.

In the field of the little household electric appliances it is known a number of apparatus such as flat irons, cleaning devices of various kinds, and so on, requiring for their operation steam produced by a separate generator and using an electric resistance as a heat source.

These steam generators are generally filled manually at cold boiler, in such a way that, when the quantity of water initially loaded in the boiler is finished, it is first necessary to let the boiler cooling down and then to refill it with fresh water and await until water is heated and becomes steam.

This system has the risk to cause scaldings to the user when the latter, being in a hurry, as it often happens, tries to open the boiler to refill it before it has sufficiently cooled down.

Several devices were hither to proposed, consisting of valves and filling cups, but they do not solve the above mentioned problem, unless complex and expensive devices are used for this purpose.

The easiest solution indeed would be to add water by a micropump, already available on the market and used for instance on the coffee percolators, picking up water from an external reservoir, but to do as according to the state of the art it is necessary to provide the steam generator with several devices, namely a device controlling maximum and minimum water level, pressure switch, thermostat, in addition to the safety valve already provided on the known manually filled steam generators, but even such an obvious solution, being used in the steam generators of bigger size, does not give good results in such an application, because with these systems when fresh water is being added, a corresponding steam pressure decrease always occurs, so that it is often necessary to discontinue the use of the steam utilizing appliance.

As a matter of fact, in these little steam generators, the biggest difficulty consists in feeding the steam generator with such a little quantity of water as to cool the system without causing such an excessive decrease of the steam pressure, as to restrict or break steam flow.

SUMMARY OF THE INVENTION

The present invention makes use of a pump as a water loading element in the pressurized steam generator, and overcomes all the above mentioned drawbacks and allows to feed the steam generator almost without decreasing its internal pressure, and moreover does not require for its operation the above indicated special control and regulation devices, as it uses for this purpose a simple microswitch having the function of pressure regulator and a simple temperature controller having the function of regulating the supply of cold water to the boiler.

The invention consists in having devised a particular form of the boiler of the steam generator according to which it is extremely easy to obtain a very sensible control of the pressure variation in the steam generator, without using the known pressure switches and the devices controlling maximum and minimum water level, requiring pressure differentials of a certain amplitude in order to switch off and on the electric resistance being the heat source of these devices.

This is obtained by making the boiler body with a U-shaped curved pipe closed at both ends and assembling said pipe with the two legs arranged superposed so that the lower leg has the function of true boiler where water and heating members are contained, and the upper leg has the function of steam dome; by controlling steam pressure with the variation of curvature of the pipe according the variation of the inner pressure, as it happens for instance in the tubular spring pressure gauges; and by using as a control member for switching on and off the electric heating resistance, a simple microswitch applied between the two ends of the legs of the U pipe, so that the microswitch is closed as the two ends approach to each other, when inside the U pipe there is litte or no pressure and therefore the feeding current of the electric heating element inserted in the lower leg of the steam generator is allowed to flow, while is opened and breaks the current flow when the legs, reaching the desired pressure, are spread apart for the distance corresponding to the maximum pressure required in the steam generator; by effecting control of the water feed from the pump by a temperature controller (thermostat) applied either on the cold water feeding pipe arranged at the maximum water level in the lower leg of the U pipe used as a boiler, or on the body of the steam generator at said maximum water level so that the pump is actuated when water level decreases because of the higher temperature of the wall on which the temperature controller is arranged, and is stopped when said wall cools down almost at once because of the cold water feed.

It has been found that with this system one obtains a very sensitive pressure regulation, much more than with the conventional pressure switches, as short opening and closure strokes of the two legs of the U pipe forming the boiler are sufficient to attain switching off and on the heating element, and the same is applicable for actuating and stopping the pump by the thermostat, in such a way that with this system the boiler is being fed with such little water quantities that, although they have an influence on the temperature of the wall on which the temperature controller is applied, when filling water or when lowering the water level, the temperature of the mass is altered only in a very negligible way and therefore the steam pressure is not being affected, as it is held almost constant in view of the kind of regulation of said pressure that may be obtained according to the invention, as hereinbefore stated.

BRIEF DESCRIPTION OF THE DRAWINGS

The present invention will be better understood by referring to the description of an embodiment given as a non limiting example only and illustrated in the accompanying sheets of drawings, in which.

DESCRIPTION OF THE PREFERRED EMBODIMENT

Figure 1:
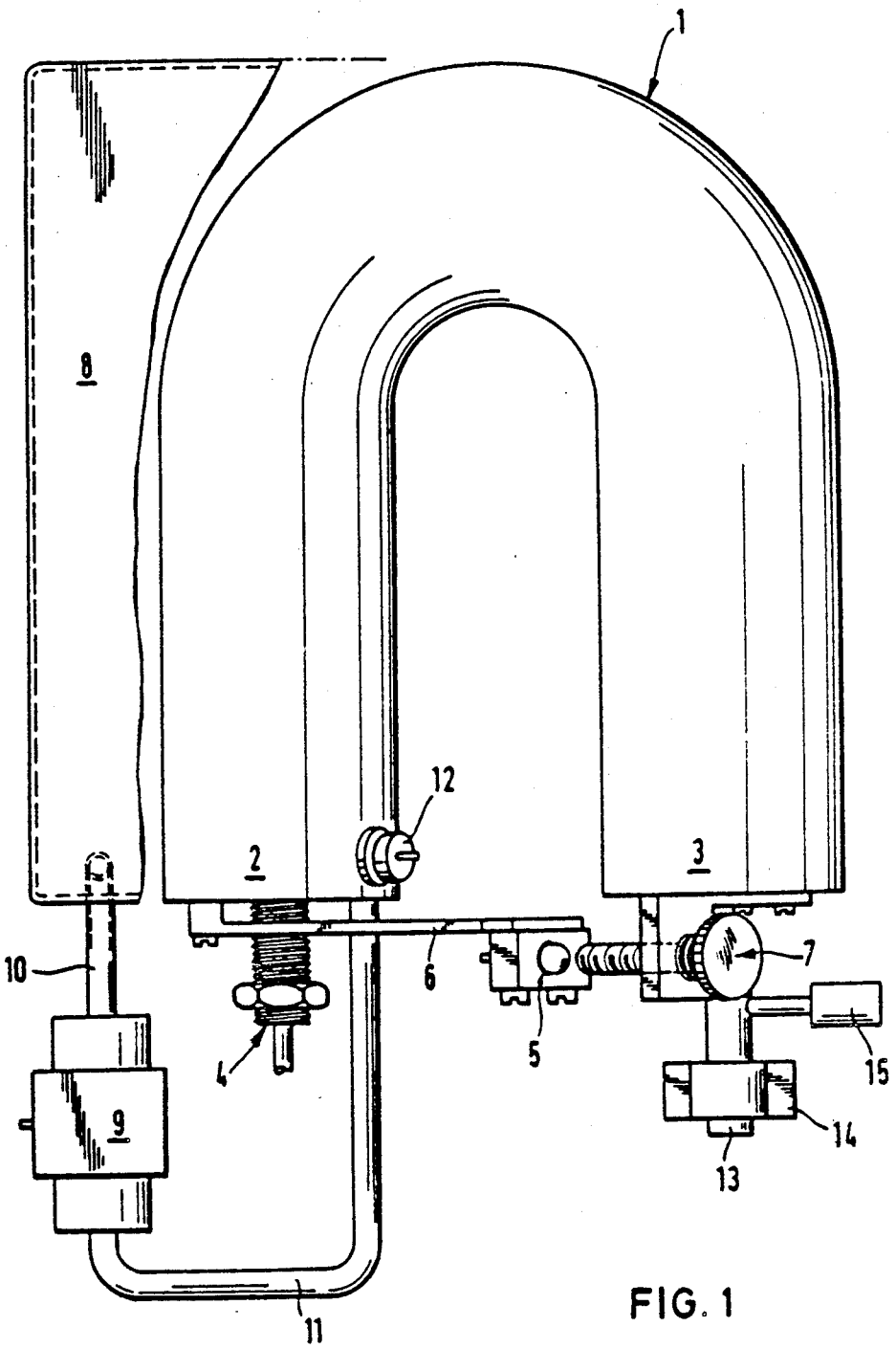
FIG. 1 is a plan view of a steam generator according to the present invention.
Figure 2:
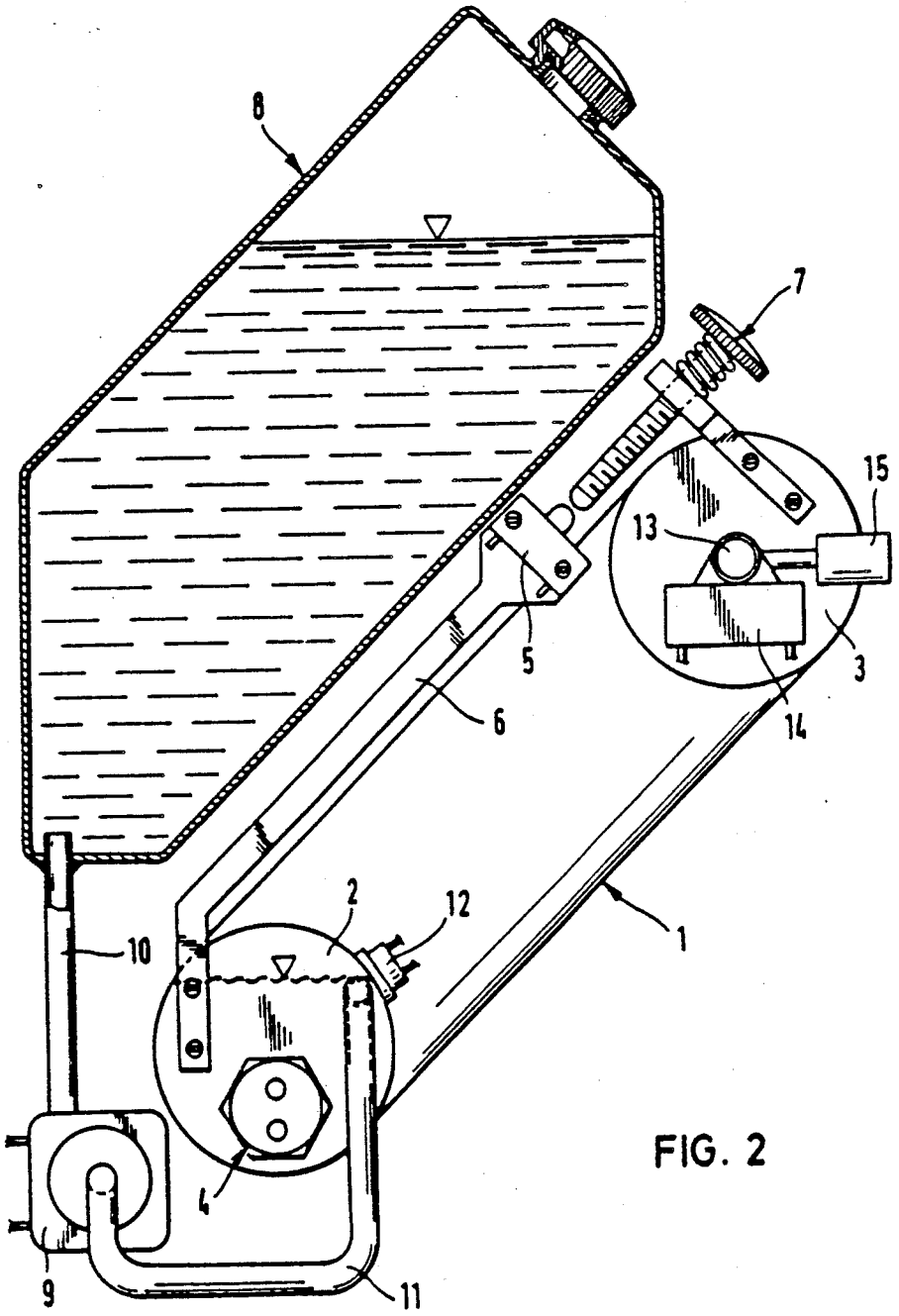
FIG. 2 is a front view of the steam generator of the invention.

With reference to FIGS. 1 and 2, the steam generator according to the present invention consists of a boiler 1 formed by a pipe of suitable diameter according to the steam production required, bent in the form of a U and closed at both ends.

The steam generator is supported in such a way that, when it is placed on a horizontal plane, the two legs 2 and 3 of the U pipe of the boiler 1 are lying on two superposed horizontal parallel planes; for instance the upper leg 3 is inclined at 45 degrees in respect to the lower leg 2 as shown in the drawings.

Through the fore part of the closure base of the lower leg 2, an electric heating resistance 4 is inserted; between the two ends of the legs 2 and 3 and outside them there is a microswitch 5 e.g. supported by a rod 6 mounted on the lower leg 2, said microswitch 5 being inserted in the electric power supply circuit for the heating resistance 4 of the boiler 1.

On the other leg 3 of the boiler 1, and in such a position as to act against the push-button of the microswitch 5, there is a stylus 7 screw-threded on a support so that it is possible to modify its distance from the push-button of the microswitch 5.

When the steam generator is cold, the ends of both legs are in the position initially chosen and the stylus 7 is regulated so as to push on the microswitch 5 and to close the circuit feeding electric current to the electric heating resistance 4.

A reservoir 8 for a suitable amount of cold water is arranged adjacent to the U-shaped element being the steam boiler 1 of the steam generator.

Such a reservoir 8 may have a capacity equal to the maximum volume of liquid that may be contained in the boiler 1 filled up to the maximum level, or it may even have a greater capacity and in the latter case it has to be provided with a level indicator to show a water withdrawal equal to the quantity required to fill up the boiler 1 to its maximum level, when the first loading of the boiler 1 is carried out.

An electric pump 9 of conventional kind, such as an electromagnetic pump commonly used for the little household appliances, connects the reservoir 8 through pipes 10 and 11 with the lower leg 2 of the boiler 1 at the location of the maximum level that water may reach in said leg 2 of the boiler 1. A thermostat 12 inserted in the circuit feeding electric current to the pump 9, is arranged on the pipe length 11, in a position just close to its entrance in the boiler 1, or on the outer wall of the leg 2 at the maximum water level in the boiler 1.

Figure 3:
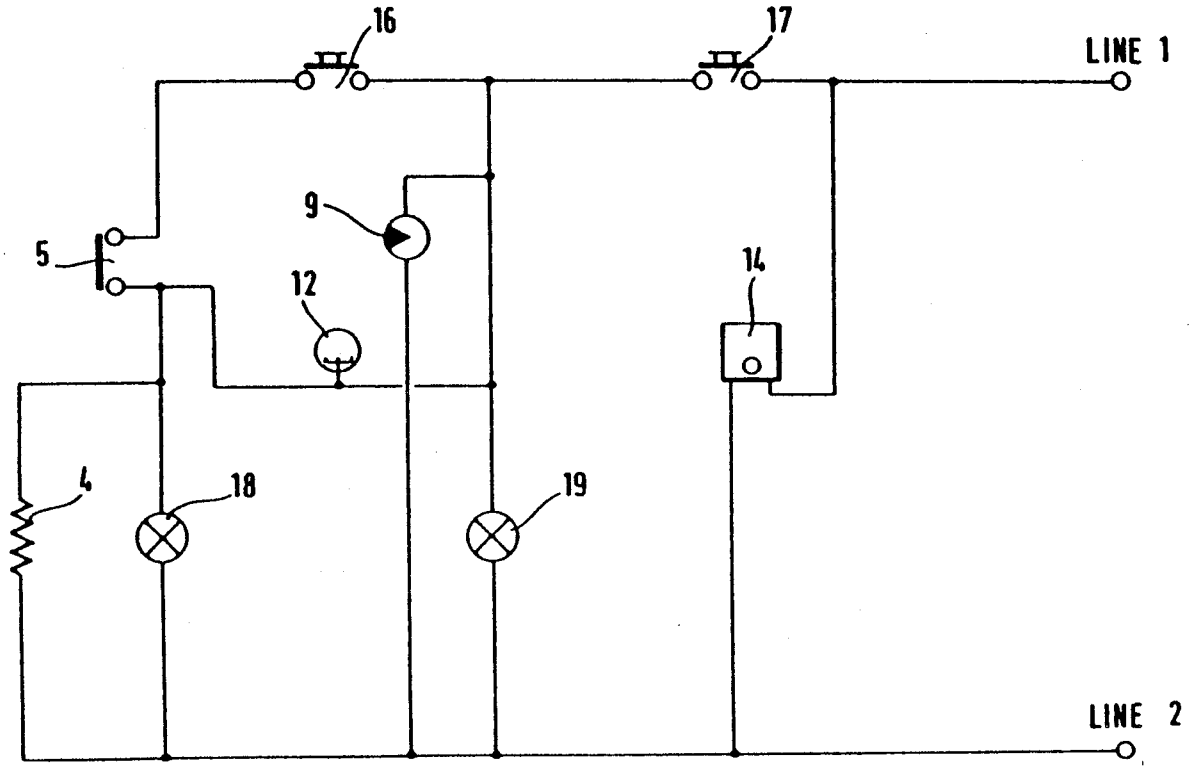
FIG. 3 is a diagrammatic view of the electric connections.

In the uppermost part of the leg 3, which is superposed to the leg 2, there is connected a pipe 13 for the outlet of the steam to be fed to the utilizer, through an electric valve 14 controlled by a push-button 17 arranged on the same utilizer (FIG. 3).

A safety valve 15 is also provided to complete the control and regulation devices of the boiler. Finally a push-button 16 is also provided, allowing manual operation of the pump 9, as shown in FIG. 3.

In FIG. 3 there is the electric diagram showing the connections of the various devices adapted to operate the boiler, where two pilot lamps 18 and 19 are also indicated, which are adapted to show the actuation of the heating resistance and the filling pump, respectively.

Figure 4:
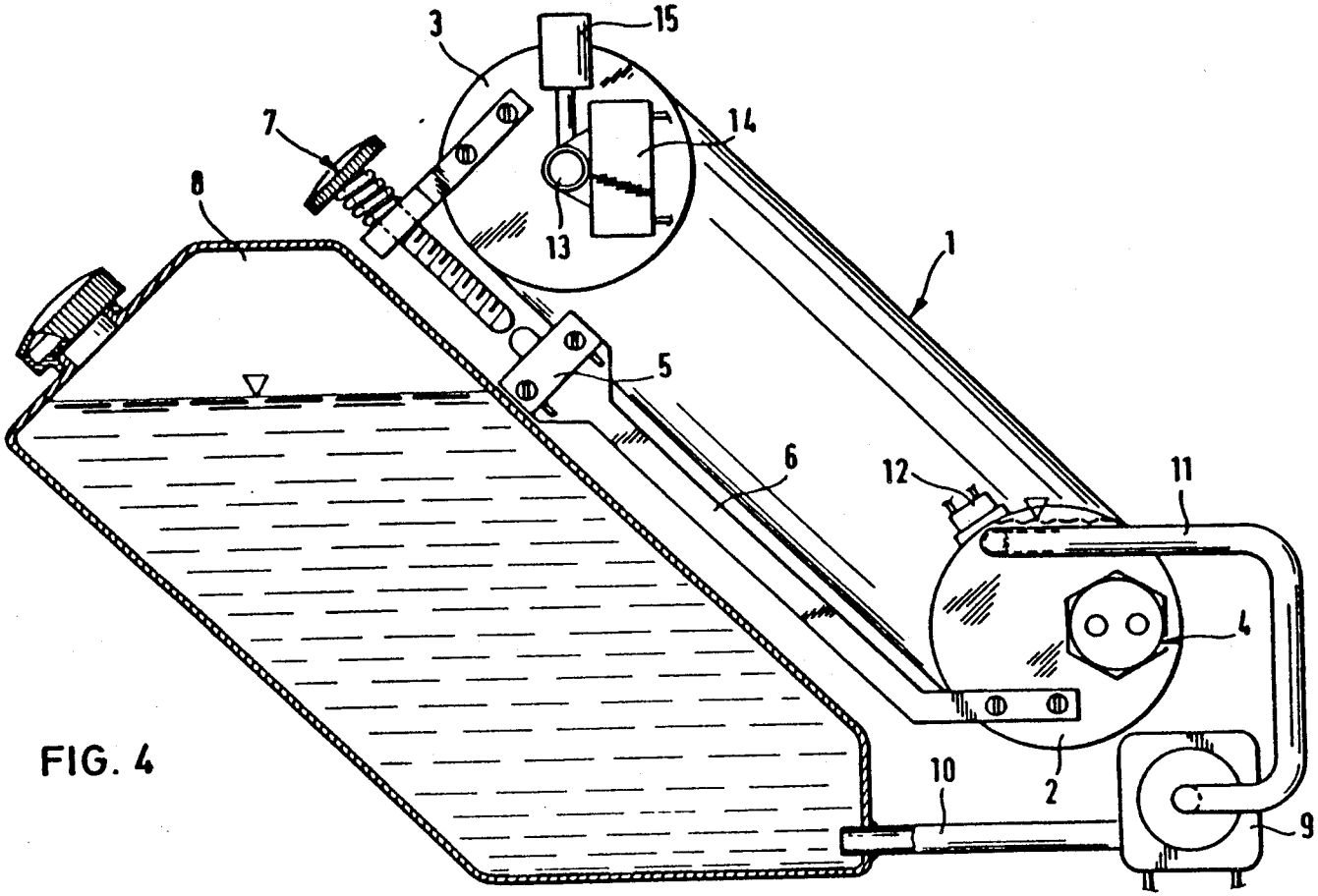
FIG. 4 is a view turned at 90 degrees of the steam generator shown in FIG. 2.

It was also found that if the inclination to the horizontal supporting plane between the two legs of the U pipe forming the boiler body according to the invention is of 45 degrees, the device may be assembled so as to take two positions, the one in vertical development as shown in FIG. 2 and the other in horizontal development as shown in FIG. 4, in both positions the arrangement being in two superposed planes for the legs 2 and 3 of the boiler 1, such a feature allowing several solutions for the assembly of the device according to the invention, because in the higher arrangement of FIG. 2 it may be used as a steam generator for a flat iron while in the lower arrangement of FIG. 4, it may be used as a steam generator for a cleaning and washing appliance, possibly mounted on wheels.

The operation of the device according to the present invention is the following.

The auxiliary reservoir 8 is filled up with water. Water is then transferred to the boiler 1 up to its maximum loading level by acting on the push-button 16 for the manual operation of the pump 3, and to do this there are several possibilities.

If the reservoir 8 has a capacity equal to that of the boiler 1 at its maximum level, the operation merely consists in emptying the reservoir 8 and then refilling it up.

If the reservoir 8 has a capacity greater than that of the boiler 1 at its maximum level, the operation consists either in emptying the reservoir 8 up to the level mark provided on it and corresponding to the water quantity which may be contained in the boiler 1 up to its maximum level, or in calibrating the stylus 7 in such a position as to actuate automatically the microswitch 7 so as to stop the pump at the pressure created in the boiler by compression of air contained in it, when during filling, water reaches the predetermined maximum level in the boiler.

When through the action of the heat produced by the electric resistance 4, water produces steam and said steam reaches the desired pressure, corresponding to the first switching off of the pilot lamp 18, to be regulated by adjusting the stroke of the microswitch 5 acting on the stylus 7, the boiler is ready for use. As from this moment, and during the entire period of use, everything happens automatically, it being sufficient to keep water in the reservoir 8.

Indeed the microswitch 5, regulated on opening and closure of the legs 2 and 3 of the boiler 1, controls switching on and off of the electric resistance 4, while the thermostat 12 controls actuation and stopping of the feeding pump 9.

It was tested and found that with the use of the steam generator according to the present invention, based on the particular shape of the boiler 1, which allowed to replace the conventional pressure switch with a simple microswitch 5 to regulate the pressure as well as with the particular position in which the temperature controller 12 is applied at the point of maximum water level in the boiler, the maximum operative pressure during the operation of the steam generator is resumed almost instantaneously after a steam delivery, and the same happens when cold water is being fed.

Furthermore it is to be pointed out that, even if the boiler is filled above the maximum admissible level because of some mistake at the beginning of the working cycle, this however does not hinder the regular operation of the pump, because the portion acting as a steam dome is very big, more than fifty percent of the entire boiler volume. Indeed the big volume of the boiler portion acting as a steam dome is a further feature of the device, because at the outlet pipe 13 one obtains always dry steam.

Finally it is to be pointed out that on the basis of the electric diagram of FIG. 3 the temperature controller 12 is shunted on the line of microswitch 5, obtaining the further advantages that supply of cold water takes places only with the electric resistance 4 switched on and in case of a failure of the temperature controller 12 with the pump in action, the supply of a greater amount of water causes in the boiler an increase of pressure and therefore actuation of the microswitch 5.

I claim:

1. A utility steam generator with self-controlled pressure for small household electrical appliances fed by a pump and using an electrical resistance heating means, the improvement comprising:

a boiler comprising a U-shaped pipe having first and second closed ends thereon and superposed lower and upper legs, said lower leg functioning as a boiler containing water and said heating means and said upper leg functioning as a steam dome and the control of steam pressure being effected by utilizing a variation of pipe curvature when the internal pressure in said pipe varies;

a source of electric current;

a microswitch coupled to said source of electric current and mounted between said first and second closed ends of said upper and lower legs such that said microswitch is closed when said ends are moved toward each other due to decreased pressure for applying said source of electric current to said heating means and said microswitch is opened disconnecting said source when the desired pressure is reached and said legs are spread apart at a distance corresponding to the maximum desired pressure;

means for connecting said pump to said lower leg for feeding water to said boiler;

a temperature controller for controlling feeding of water to said boiler by said pump coupled to the maximum desired water level in said boiler whereby said pump is actuated when the water level decreases exposing said temperature controller to a higher temperature in said boiler and said pump is stopped when said boiler cools down because of cold water being fed into said boiler by said pump.

2. The steam generator as claimed in claim 1 wherein the mounting of said microswitch between said legs includes a support on one of said legs and a stylus on the other and means for adjusting the distance between said stylus and said microswitch thereby providing a means for regulating the maximum pressure in the steam generator.

3. The steam generator as claimed in claim 2 wherein said stylus is calibrated at a pressure corresponding to that created in the boiler under the effect of compression of the air contained therein such that in filling said boiler to its maximum level said pump is automatically stopped when the maximum admissible level is reached inside said boiler.

4. The steam generator as claimed in claim 1 having an auxiliary reservoir coupled to said pump.

5. The steam generator as claimed in claim 4 having means for manually actuating said pump for transferring a predetermined quantity of water from said reservoir to said boiler to a maximum admissible level at the beginning of a working cycle.

6. The steam generator as claimed in claim 4 wherein said reservoir has a designed volume corresponding to the volume of the boiler filled up to a maximum level whereby the boiler is operated by filling the reservoir, manually actuating said pump to deliver the contents of the reservoir to said boiler and then refilling said reservoir.

7. The steam generator as claimed in claim 4 wherein said reservoir is provided with a mark corresponding to a quantity of water which when emptied from the reservoir corresponds to the quantity of water required for filling said boiler to its maximum level.

8. The steam generator as claimed in claim 1 wherein said temperature controller is shunted to said microswitch to ensure that filling said boiler occurs only when said electric heating resistance means is switched on thereby providing an additional safety measure in case of failure of said temperature controller when said pump is operative.

9. The steam generator as claimed in claim 1 wherein said upper leg is inclined 45 degrees to the horizontal support plane of said lower leg whereby said boiler may assume two positions turned at 90 degrees to one another in respect of such a horizontal plane either a vertically arranged position or a horizontally arranged position.

* * * * *